US005154570A

United States Patent [19]

Yoshikawa et al.

[11] Patent Number: 5,154,570

[45] Date of Patent: Oct. 13, 1992

[54] VERTICAL SHAFT PUMP

[75] Inventors: Yoshihiko Yoshikawa, Tsuchiura; Shizuichi Sakamoto, Toride; Sumio Sudo, Ibaraki, all of Japan

[73] Assignee: Hitachi, Ltd., Tokyo, Japan

[21] Appl. No.: 575,424

[22] Filed: Aug. 30, 1990

[30] Foreign Application Priority Data

Sep. 6, 1989 [JP] Japan ..... 1-229186

[51] Int. Cl.[5] ..... F04D 13/00

[52] U.S. Cl. ..... 415/24; 415/115; 415/914; 417/90

[58] Field of Search ..... 415/24, 115, 116, 169.1, 415/182.1, 183, 208.1, 914; 417/36, 90

[56] References Cited

U.S. PATENT DOCUMENTS

| | | | |
|---|---|---|---|
| 1,730,748 | 1/1928 | Schmidt | 415/914 |
| 1,748,892 | 2/1930 | Nagler | 415/115 |
| 2,142,772 | 1/1939 | Athey | 417/90 |
| 4,515,524 | 5/1985 | Fisher, Jr. | 415/914 |
| 4,756,671 | 7/1988 | Grimes et al. | 417/90 |
| 4,898,512 | 2/1990 | Geffs | 415/119 |
| 5,074,746 | 12/1991 | Konishi | 415/24 |

FOREIGN PATENT DOCUMENTS

| | | | |
|---|---|---|---|
| 90697 | 4/1988 | Japan . | |
| 150097 | 10/1988 | Japan . | |
| 76588 | 5/1989 | Japan . | |
| 1121510 | 10/1984 | U.S.S.R. | 415/115 |

*Primary Examiner*—Thomas E. Denion
*Assistant Examiner*—Michael S. Lee
*Attorney, Agent, or Firm*—Antonelli, Terry, Stout & Kraus

[57] ABSTRACT

A vertical shaft pump to be disposed in a pump pit comprises a pump casing having a suction opening, and an impeller disposed in the pump casing below a position corresponding to the lowest water level in the pump pit below which the pump starts to suck air through the suction opening during operation. A series of intake ports are provided in the pump casing below the impeller with equal intervals in the circumferential direction of the pump casing. These intake ports act to introduce atmospheric air into the pump casing through intake pipes when the pressure at the intake ports is lowered below the atmospheric pressure.

28 Claims, 6 Drawing Sheets

R1 : RADIUS OF IMPELLER INLET
r : RADIUS OF ARBITRARY POINT OF INLET (DISTANCE FROM AXIS)
Cu1 : CIRCUMFERENTIAL FLOW SPEED AT IMPELLER INLET
U2 : CIRCUMFERENTIAL FLOW SPEED AT IMPELLER OUTLET
φ : HEAD COEFFICIENT

VERTICAL SHAFT PUMP

FIELD OF THE INVENTION

The present invention relates to a vertical shaft pump and, more particularly, to a vertical shaft pump which is disposed in a pump pit (also called "pump well") provided in the basement or the like of a building in town and city for temporarily collecting urban waste water, for example, and which is capable of performing a normal pumping operation even when a water level in the pump pit is lowered, conducting an operation (called "anticipatory stand-by operation") prior to rising of the water level in the pump pit due to flood during a rainfall, for example, and further carrying out a management operation of the pump in normal time.

DESCRIPTION OF THE PRIOR ART

One of this type of conventional vertical shaft pumps is disclosed in Japanese Unexamined Patent Publication No. 63-90697 (1988). In this pump, an impeller is provided at a position slightly above the particular location specific to a pump, corresponding to a water level below which air may be sucked in the submerged state of the pump, i.e., the lowest water level. A suction bell mouth is disposed at such a position that a suction opening in its lower end is submerged in a necessary and sufficient amount. A vacuum break hole communicating with the atmosphere is formed in a pump casing substantially at the same level as the particular location specific to the pump. When the water level is lowered below a height corresponding to the lowest water level, the vacuum condition is broken to bring the pump into an idling state, whereby water in the pump is let to fall to interrupt the discharging operation of the pump.

Another conventional vertical shaft pump is disclosed in Japanese Unexamined Utility Model Publication No. 63-150097 (1988). With this pump, an impeller is disposed at a position lower than a water level in a pump pit. A through-hole communicated with the exterior is bored through a pump casing near the inlet of the impeller. The through-hole is connected to one end of a pipe which has the other end open in the pump pit adjacent to a level to which the impeller is submerged, so that air is sucked through the through-hole when the water level is lowered.

In general, in an attempt to perform an anticipatory stand-by operation based on a rainfall forecast information or the like, it is desired that a vertical shaft pump can perform its discharging operation at a water level as low as possible in order to increase storage capacity of the pump pit and conduits. It is also required to obtain a proper pump flow rate depending on a water level in the pump pit for the purpose of preventing the occurrence of vortex, suppressing surge of the water level in the pump pit and achieving a stable operation of the vertical shaft pump.

In the above-described first vertical shaft pump of the prior art, however, no consideration is paid to the discharging operation at a water level below the lowest water level. As one example of this, the pump cannot perform the discharging operation at the water level below the known lowest water level which is located above the suction opening of the suction bell by a distance 1.4–1.7 times the diameter of the suction opening.

The above-described second vertical shaft pump of the prior art has a characteristic that, when the water level in the pump pit is lowered below the level of the open end of the afore-said pipe, air is sucked through the open end of the pipe and the pumping capability of the vertical shaft pump is gradually lowered with a descent of the water level, so that the pumping operation can be performed even at a lower water level, whereby the pump operation is changed to an idling state not abruptly but smoothly. This prior art is, therefore, regarded as suitable to, for example, those pumps carrying out the so-called anticipatory stand-by operation in which the pump is idly operated so as to be ready for flood before water will start flowing into the pump pit abruptly. The second vertical shaft pump is arranged such that the other end (the upper end) of the pipe communicating with the aforesaid through-hole is opened in the pump pit adjacent to a water level to which where the impeller is submerged, whereby air is sucked when the water level is lowered below the open end of the pipe. This results in a feature that the water level at which the vertical shaft pump starts sucking air can be determined by the level of the open end of the pipe. However, when the water level is above the level of the pipe open end, water is sucked through the pipe open end. Therefore, if the water in the pump pit contains foreign matter such as dust, those foreign matters may block the pipe open end and obstruct the air-sucking operation with the elapse of operation time. Particularly, the pump of the type intended to carry out the aforesaid anticipatory stand-by operation has a possibility that various sorts of foreign matter may flow into the pump because of an abrupt inflow of water into the pump pit due to rain falling over a wide area of a town or city.

Furthermore, the above-mentioned second pump is designed to increase an intake of air depending on a water level in the pump pit, that is, as the water level is lowered, thereby reducing the pump flow rate. To carry out the water-discharging operation while continuing suction of air, the air must be sucked in a stable manner. In this prior art, however, no consideration is paid to means for stably sucking air.

SUMMARY OF THE INVENTION

An object of the present invention is to provide a vertical shaft pump which can perform a stable water-discharging operation while sucking air.

Another object of the present invention is to provide a vertical shaft pump in which the pump flow rate can be controlled depending on a water level and which can perform the water-discharging operation in a stable manner at a water level lower than the conventioanl lowest level without causing adverse vortex.

Still another object of the present invention is to provide a vertical shaft pump which produces no vibration when it is performing a water-discharging operation while sucking air.

Yet another object of the present invention is to provide a vertical shaft pump which can prevent foreign matter in a pump pit from obstructing suction of air to assure a stable and to positive air-sucking operation, and allow a water level at which the pump starts sucking air to be set as desired.

To achieve the above objects, the present invention provides a vertical shaft pump for use in a pump pit, the pump comprising a pump casing having a suction opening; an impeller disposed in the pump casing below a position corresponding to the lowest water level in the pump pit below which the pump starts to suck air through the suction opening during an operation; a plurality of air intake ports provided in the pump casing at a position below the impeller with equal intervals in the circumferential direction of the pump casing; and intake pipe means for communicating the air intake ports with the atmosphere.

The number of the air intake ports may preferably be equal to or greater than the number of vanes of the pump impeller, and most preferably, be equal to an integer multiplied by the number of vanes.

In a preferred embodiment of the present invention, the air intake ports are located in the pump casing at a position spaced inwardly from the inner wall surface of the pump casing.

In a preferred embodiment of the present invention, projections are provided on the inner wall surface of the pump casing adjacent to the air intake ports.

In a preferred embodiment of the present invention, the intake ports are located below the portion of the pump casing having the minimum inner diameter.

In a preferred embodiment of the present invention, the intake ports are located in the pump casing at a position spaced inwardly from the inner wall surface of the pump casing, and the position of the intake ports is set to meet the following relation;

$$0.2R_1 \leqq h \leqq 0.6R_1$$

where h is a distance from the casing inner wall surface to the intake ports and $R_1$ is the radius of the casing inner wall surface at the position of the intake ports. The intake ports are preferably each formed in a rib which is provided on the inner wall surface of a suction bell of the pump casing in order to diminish the swirling flow.

Meanwhile, it has been found that, in a pump provided with an intake port formed in the pump casing and intended to carry-out a water-discharging while sucking air, since the intake port is disposed close to the pump impeller, an influence of the swirling reverse current caused by the impeller makes the pressure at the intake ports unstable, so that an intake of air is not stable and vibration is generated.

It has also been found that, since the sucked water flows while swirling in the pump casing adjacent to the suction port disposed close to the pump impellers, centrifugal forces of the swirling water act on the suction ports to prevent a sufficient negative pressure from being generated at the intake ports, whereby a sufficient amount of air cannot be obtained.

With the present invention, since a plurality of intake ports are formed in the pump casing, an intake of air can be stabilized and vibration of the pump can be diminished when a water-discharging operation is performed while sucking air. In particular, the number of intake ports may be equal to or greater than the number of the vanes of the pump impeller or be equal to an integer multiplied by the number of vanes, and the intake ports may be disposed with equal intervals in the circumferential direction. As a result, therefore, air can be sucked in a stable manner to evenly flow into and through the flow paths between the respective pump vanes, thereby achieving a stable pumping operation with a reduced degree of vibration.

Further, the swirling flow speed is reduced as the flow is inwardly spaced from the inner surface of the pump casing or the suction bell. By locating the intake ports in the pump casing at positions spaced inwardly from the inner wall surface of the pump casing, therefore, an influence of the swirling flow speed is lessened and centrifugal forces due to the swirling flow are reduced so as to assure sufficient and stable suction of air. Particularly, by setting the distance h from the casing inner wall surface to the intake ports to meet the relation of $0.2R_1 \leqq h \leqq 0.6\ R_1$ with respect to the radius of curvature of the casing inner wall surface $R_1$, the influence of the swirling flow can be lessened to a large extent. With the preferred embodiment in which ribs are provided on the inner wall surface of the pump casing to diminish the swirling flow and the intake ports are formed in the ribs, respectively, the ribs serve to reinforce the intake ports themselves or the members where the intake ports are formed, so that the intake ports can be protected from damage. In addition, the ribs also serve to impede the swirling flow and contribute to more stable suction of air. Alternatively, ribs or projections may be provided close to the respective intake ports to prevent or diminish the swirling flow in the vicinity of the intake ports. In this case, the intake ports can be provided in the inner wall surface of the pump casing, while the influence of the swirling flow is kept to be minimum to assure stable suction of air.

Moreover, with the present invention, since the end of the intake pipe means open to the atmosphere may preferably be positioned above the highest water level in the pump pit as mentioned above, there is no possibility that foreign matters such as dusts floating in the water within the pump pit adhere to and block the open end of the intake pipe means to obstruct the air sucking operation when the water level is lowered.

The pressure at the intake ports can be increased and decreased through utilization of the flow in the pump casing by providing the intake ports in an inclined relation with respect to a plane perpendicular to the axis of the pump, or by locating the intake ports at a position offset downwardly from the portion of the pump casing having the minimum inner diameter, or by providing projections on the inner wall surface of the pump casing above or below the intake ports. Depending on the given specifications and dimensions of pumps, therefore, it is possible to design or set the pressure at the intake ports equal to the atmospheric pressure for a desired water level in the pump pit at which suction of air is to start, so that air may be sucked when the water level lowers below the desired one.

Thus, according to the present invention, the plurality of intake ports provided in the pump casing make it possible to stabilize a intake of air and diminish vibration of the pump when it is performing a water-discharging operation while sucking air.

According to the embodiment in which the intake ports are opened in the pump casing at positions spaced inwardly from the inner wall surface of the pump casing, or in the embodiment in which the ribs for impeding the swirling flow are provided close to the intake ports, it is possible to lessen the influence of the swirling flow near the inlet opening of the pump impeller and reduce the centrifugal forces of the swirling fluid. This is advantageous in obtaining sufficient and stable suction of air and diminishing vibration of the pump.

According to the means capable of increasing and decreasing the static pressure at the intake ports, the water level at which suction of air starts can be set to a desired level. The embodiment in which the number of intake ports is selected to be more than the number of vanes of the impeller is advantageous in that vibration of the pump can be kept from increasing during suction of air, because the sucked air can be uniformly distributed into the flow paths defined between the respective vanes of the impeller.

In addition, the present invention is also effective to prevent foreign matter from adhering to or blocking the air inlet port or open end of the intake pipe means and obstructing the operation of sucking air since the impeller is disposed below the lower water level, the intake ports are provided in the pump casing at a position below the impeller, the intake pipe means is connected to the intake ports, and the air inlet port of the intake pipe means is opened to the atmosphere at a position above the highest water level in the pump pit.

DESCRIPTION OF PREFERRED EMBODIMENTS

Preferred embodiments of the present invention will be described hereinunder with reference to the accompanying drawings.

Figure 1:
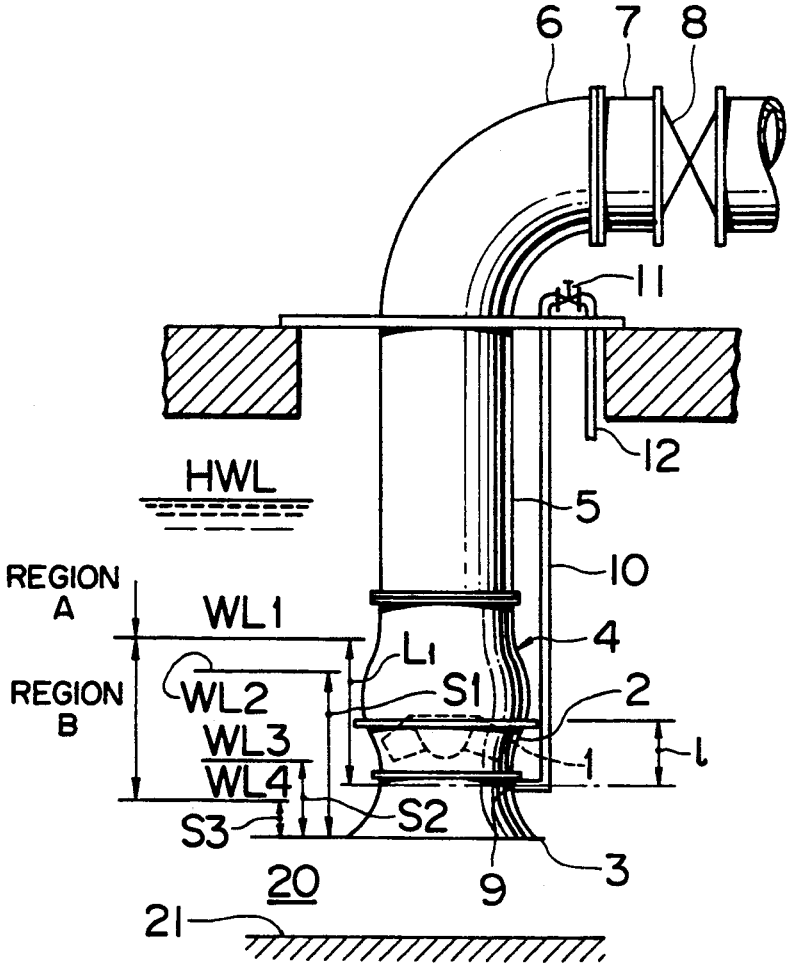
FIG. 1 is a schematic side view of a vertical shaft pump to which the present invention is applied.

In FIG. 1, a casing liner 2 of a pump casing 4 accommodating an impeller 1 therein has a lower end to which a suction bell 3 of the pump casing 4 is connected, and an upper end to which an upstanding discharging pipe 5 and then a discharge elbow 6, as parts of the pump casing 4, are connected, thereby constituting a vertical shaft pump. This pump is disposed in a pump pit 20 having a bottom 21. A discharge pipe 7 and a discharge valve 8 are disposed on the discharge side of the discharge elbow 6. An air-intake port 9 is formed in the pump casing 4 at a position below the impeller 1 but in the vicinity thereof. An intake pipe 10 is disposed in connection with the intake port 9 with an intake air regulating valve 11 provided midway the intake pipe 10. A suction port 12 of the intake pipe 10 is located at a position higher than the highest water level (HWL) in the pump pit 20, thereby constituting a flow rate controller of the pump. The intake port 9 is located at such a position that no air is taken through the intake port 9 at the conventional lowest water level, i.e., the lowest water level WL1 specific to the pump below which air may be sucked through the lower end of the suction bell 3.

Static pressure P(m) at the intake port 9 is expressed by;

$$P = Po + l - hs - k \cdot \frac{v^2}{2g} \quad (1)$$

where Po is atmospheric pressure (10.33 m), l is water level (m), hs is loss of head (m) at the suction port of the pump casing, v is flow speed (m) of a fluid being handled at the intake port, and k is constant.

If the static pressure P at the intake port 9 is larger than Po, no air is taken through the intake port 9. In other words, if $[l > hs + k(v^2/2g)]$ is set, no air is taken therethrough. Accordingly, the intake port 9 is located at a position below the conventional lowest water level WL1 by a distance given by $[hs + k(v^2/2g)]$. As a result, in the case where the water level is in a region A above the level WL1, the pump sucks no air and hence can perform a water-discharging operating with a predetermined pump capability. When the water level is in a region B below the level WL1, the pressure P becomes smaller than the atmospheric pressure as the water level l is reduced in Equation (1), whereby the pump sucks air. The intake air regulating valve 11 gives a proper loss to the intake so that a proper amount of air is sucked upon changes of the pressure P depending on changes of the water level, whereby the pump is subjected to flow rate control. When the water level is at WL2 in the region B, the pressure P is slightly lower than the atmospheric pressure and the pump flow rate is slightly reduced with a small intake of air. In this case, since the submerged depth S1 of the pump is still sufficient in relation to the pump flow rate at this time, there occurs no vortex. The pressure P is lowered substantially in proportion to a descent of the water level. Therefore, when the water level is at WL3, the pressure P becomes further lower than the atmospheric pressure and the pump flow rate is significantly reduced with an increased intake of air. As a result, there occurs no vortex even at the submerged depth S2 of the pump. When the water level is at WL4, the percentage of intake air amounts to 15%–20% of the pump flow rate, the pumping operation is interrupted, whereby the pump is brought into an idling state. The submerged depth S3 of the pump at this time is set by designing an inlet level of the suction bell to such a height that no vortex occurs at the flow rate immediately before the interruption of the pumping operation. Throughout the range in which the water level varies, the opening of the intake air regulating valve 11 may be held constant regardless of or changed depending on the water level.

With the above-described arrangement, it is possible to prevent the occurrence of vortex even at the water level lower than the conventional lowest water level WL1 and obtain a safety operation free from abnormal vibration and noise. At a water level corresponding to a transition from the idling operation to the water-discharging operation, i.e., the water level WL3 at which the impeller 1 is submerged to some extent, and at the water level slightly higher than WL4 corresponding to a transition from the water-discharging operation to the idling operation, the pump flow rate is controlled to be reduced by suction of air down to about half of the predetermined value. Accordingly, a reduced change in flow rate is assured at the time of starting and stopping the water-discharging operation, with the result that the occurrence of a surge phenomenon is suppressed and the pump is operated in a more stable manner.

From the Equation (1), it is desired that the level difference $L_1$ between the conventional lowest water level WL1 and the position of the intake port 9 is given by $L_1 = hs + k(v^2/2g)$. However, $L_1$ on the left side of the equation is determined depending on how vortex is likely to occur and is generally a function of the pump diameter. The right side of the equation is a function of v, but v is varied depending on a discharge rate, a rated total lift, a specific speed and other parameters of the pump. For the reason, if this value of k is fixed to be 1 (one), it is not always possible to design the pumps such that the pressure P at the intake port 9 is equal to the atmospheric pressure Po depending on various forms of pumps. More specifically, the relation of $[L_1 > hs + k(v^2/2g)]$ holds for those pumps which have large diameters and the low lifts. On the contrary, $[L_1 < hs + k(v^2/2g)]$ holds for those pumps which have relatively small diameters and the high lifts because $L_1$ becomes smaller and v is increased. It is, therefore, preferred that k can take a value other than 1 on the right side of the above equation, i.e., $[hs + k(v^2/2g)]$. Practical embodiments in which k can take a value other than 1 will now be described with reference to FIGS. 2 to 8.

Figure 2:
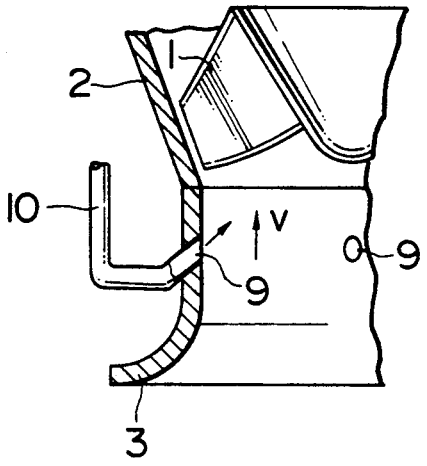
FIGS. 2, 3, 4, 6, 7 and 8 are detailed vertical sectional views of important parts of first to sixth embodiments of the present invention, respectively.
Figure 3:
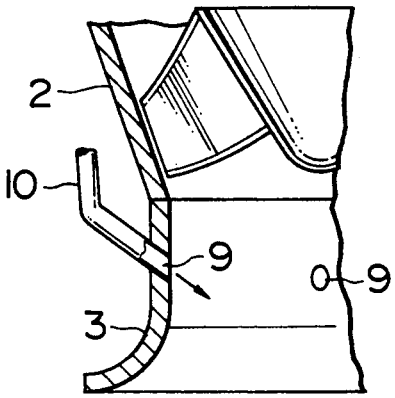

FIG. 2 illustrates a first embodiment of the present invention and is a detailed view showing a part of the pump shown in FIG. 1 in the vicinity of intake ports 9. In the pump casing 2 adjacent to the inlet for the impeller 1, that is, in the suction bell 3, a plurality of air intake ports 9 are provided with equal intervals in the circumferential direction of the pump casing 2. The intake ports 9 are each inclined in the direction of a water flow within the pump casing 2 and relative to a plane perpendicular to the pump axis. Accordingly, if the static pressure P (m) at the intake ports 9 is expressed by the above-referred Equation (1), k is given a value greater than 1 in this embodiment. On the other hand, in a second embodiment of the present invention shown in FIG. 3, the intake ports 9 are inclined in opposite relation to the flow direction within the pump casing 2. As a result, the k is of a value given by $[0 < k < 1]$. In this manner, by inclining the intake ports 9 relative to the plane perpendicular to the pump axis, the value of k in Equation (1) can be increased or decreased from 1.

Figure 4:
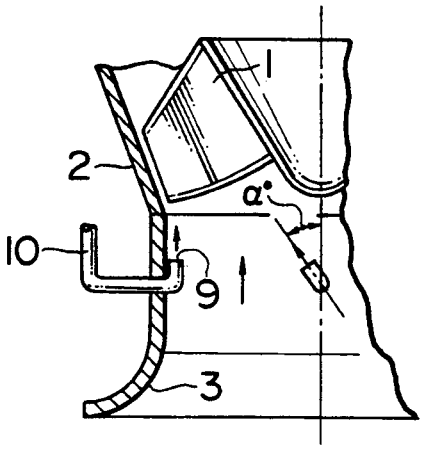
Figure 5:
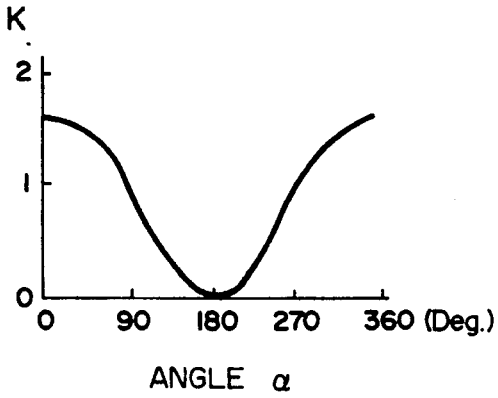
FIG. 5 is a graph showing the relation between the direction (angle $\alpha°$) of an intake port shown in FIG. 4 and a constant k in Equation (1) to be discussed later.

FIG. 4 shows a third embodiment in which the intake ports 9 are each formed in the end of a bent pipe projecting into the pump casing 2. More specifically, intake pipes 10 are provided to extend through the pump casing 2, and the inner end of each intake pipe 10 is bent such that the open end, i.e., the intake port 9, has an axis which is inclined in the swirling direction of water within the pump casing at an angle $\alpha°$ relative to the axis of the pump casing. Depending on a degree of this angle $\alpha$, the value of k in Equation (1) is varied as shown in FIG. 5. Accordingly, the value of k can be easily increased and decreased by selecting the angle $\alpha$ as desired.

Figure 6:
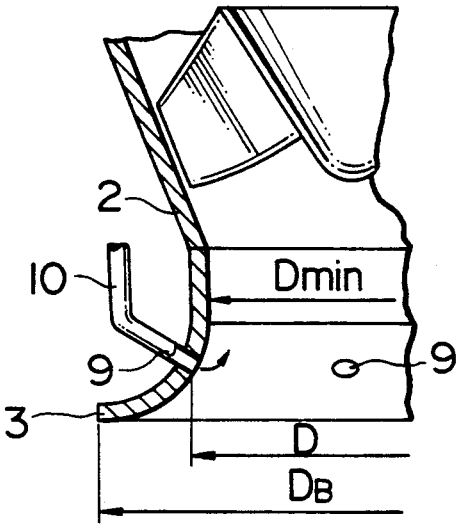

FIG. 6 shows a fourth embodiment of the present invention in which the air intake ports 9 are each provided below a position of the minimum inner diameter $D_{min}$ of the suction bell 3 of the pump casing 2. Since the diameter D of the suction bell 3 at the position where the air intake ports 9 are open is larger than $D_{min}$, the static pressure at the air intake ports 9 is higher than that at the portion of the minimum inner diameter to assure a condition $[k < 1]$. In this embodiment, the value of k can be easily varied by selecting the position of the intake ports 9 within a range from a point near the portion of the minimum inner diameter to a point near the inlet opening of the suction bell 3 (diameter $D_B$) as required.

Figure 7:
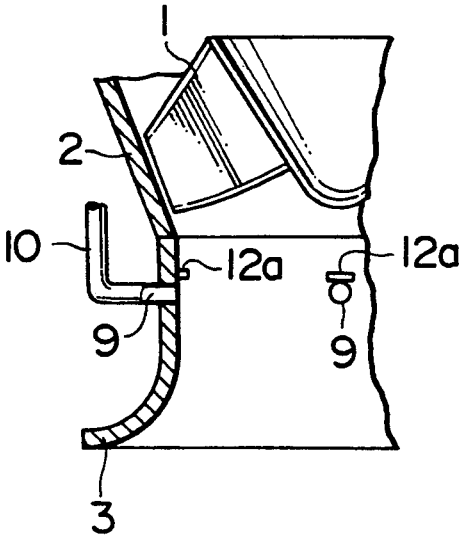
Figure 8:
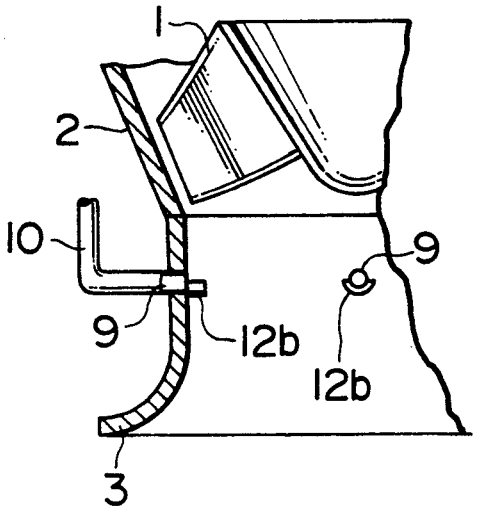

FIG. 7 shows a fifth embodiment of the present invention in which projections 12*a* are provided on the inner wall surface of the pump casing 2 above the intake ports 9 (on the downstream side). FIG. 8 shows a sixth embodiment of the present invention in which projections 12*b* are provided on the inner wall surface of the pump casing 2 below the intake ports 9 (on the upstream side). In the embodiment of FIG. 7, since the flow is interrupted by the projections 12*a*, the static pressure at the intake ports 9 provided immediately upstream of the projections 12*a* is raised, thus resulting in a condition $[k < 1]$. On the other hand, in the embodiment of FIG. 8, since the intake ports 9 are provided immediately downstream of the projections 12*b*, the static pressure at the intake ports 9 is lowered, thus resulting in a condition $[k > 1]$. In this manner, the value of k can be easily varied by selecting the position, size, shape or the like of the projections as required.

As described above, because the value of k in Equation (1) can be increased and decreased from 1.0 by adopting any of the various means shown in FIGS. 2–8, it is possible to set the static pressure P at the intake ports 9 equal to the atmospheric pressure Po for various forms of pumps different in the size, specific speed, total lift and other parameters when the water level is at the conventional lowest water level WL1.

In the above embodiments of FIG. 2 to FIG. 8, it is preferred that the number of intake ports 9 is selected to be equal to or greater than the number of vanes of the impeller, or be equal to an integer multiplied by the number of vanes, and the intake ports 9 are disposed with equal intervals in the circumferential direction of the pump casing. As a result of the experiments conducted by the inventors, it is found that in the case where only one intake port is provided, air cannot flow uniformly from the intake port into flow paths defined between respective vanes of the impeller, so that hydraulic imbalanced forces are caused to act on the impeller, thereby causing a phenomenon of increasing vibration of the pump. In contrast, by providing the intake ports plural in number, particularly, equal to or greater than the number of vanes of the impeller or be equal to an integer multiplied the number of vanes, and arranging the intake ports with equal intervals in the circumferential direction, it is assured that air can be sucked in a stable manner and evenly flow into the flow paths defined between the respective pump vanes and, hence, vibration of the pump can be diminished.

Next, still other embodiments of the present invention will be described with reference to FIGS. 9–12.

Figure 9:
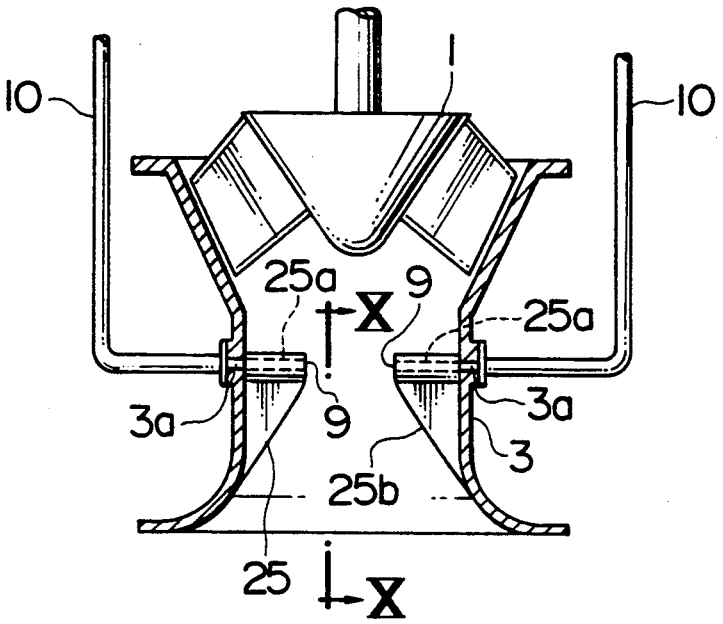
FIG. 9 is a detailed vertical sectional view of an important part of a seventh embodiment of the present invention.
Figure 10:
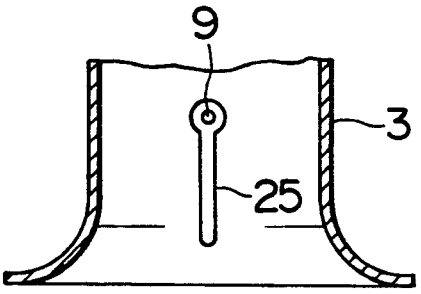
FIG. 10 is a partly sectional view taken along a line X—X in FIG. 9.

In the embodiment shown in FIGS. 9 and 10, a plurality of air intake ports 9 are provided at positions inwardly spaced from the inner wall surface of the suction bell 3 on the suction side of the impeller 1 of the vertical shaft pump. The air intake ports 9 are each open to the atmosphere through an air intake tube 10. More specifically, the intake ports 9 are formed by boring openings 3*a* in the wall of the suction bell 3 each connected to one end of the intake pipe 10, by projecting ribs 25 radially from the inner wall surface of the suction bell 3, each rib having a communication hole 25*a* communicating with an opening 3*a*, and by opening each communication hole 25*a* at an inward position relative to the inner wall surface of the suction bell 3. The ribs 25 are preferably fabricated by casting or the like so as to be made integral with the suction bell 3. Further, the ribs 25 are each provided to extend in the axial direction of the pump as shown and serve to prevent or suppress the swirling flow in the vicinity of the intake ports. Moreover, each rib 25 extends downwardly from a position adjacent to the communication hole 25*a* and has its upper end projecting from the inner wall surface of the suction bell 3 to the opening position of the intake port 9, with the projection height at the lower end of the rib 25 being lower than that at the upper end thereof. Namely, each rib 25 is formed substantially into a triangular shape. Therefore, since a lower edge 25*b* of each rib 25 is inclined downwardly and outwardly in the radial direction from about its upper end, any foreign matter such as a plastic film can be guided by the inclined lower edge 25*b* of the rib 25 toward the center of the flow path even if the foreign matter is contained in water flowing into the pump. As a result, foreign matter can be prevented from clogging the suction bell 3.

Figure 11:
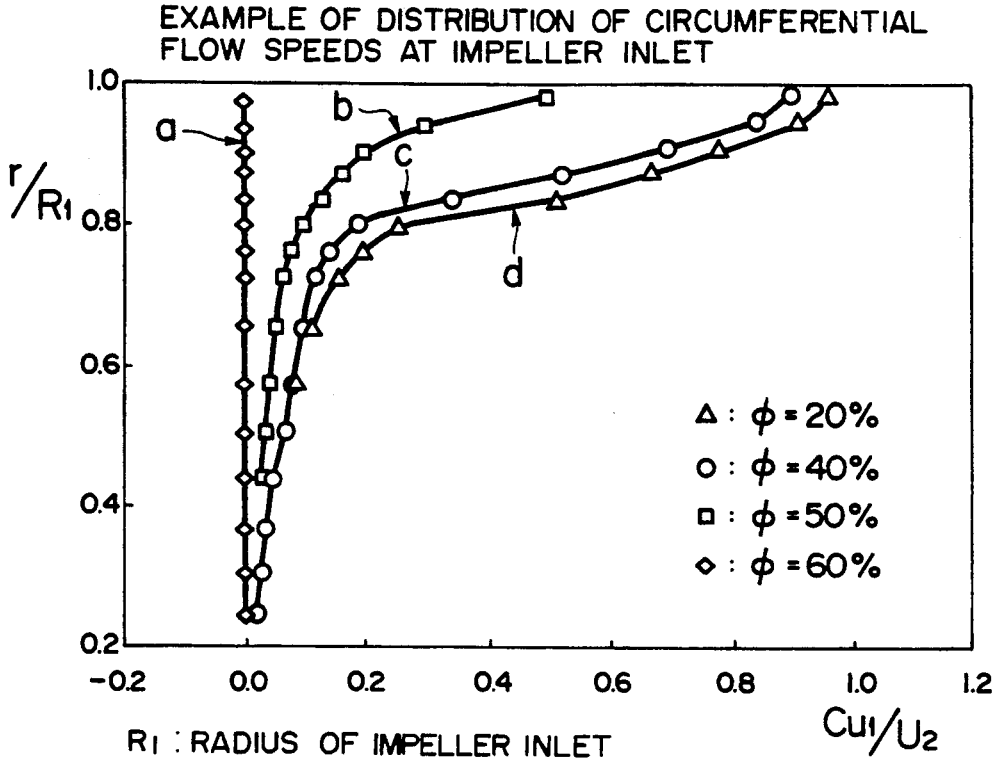
FIG. 11 is a graph showing circumferential speeds of the flow measured at different radial points adjacent to an inlet of a pump impeller.
Figure 12:
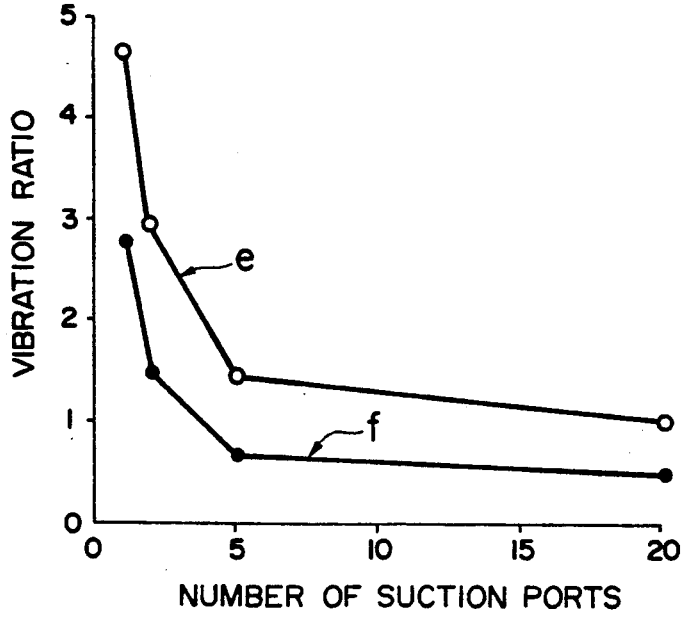
FIG. 12 is a graph showing the relation between the number of air suction ports and vibration of the pump.

In this embodiment, the air intake ports 9 are opened each at a position radially inwardly spaced from the inner wall surface of the pump casing (the suction bell 3) as mentioned above. The distance h from the inner wall surface of the pump casing to the open end of each intake port 9 is preferably set to meet the following relation:

$$0.2R_1 \leqq h \leqq 0.6\ R_1 \qquad (2)$$

where $R_1$ is the radius of the casing inner wall surface at the position of the intake port. The reason for this will be explained below. FIG. 11 is a graph showing the distribution of circumferential flow speeds at the inlets of the impellers of various pumps obtained by measuring the circumferential flow speeds (plotted on abscissa) at various points of each impeller inlet radially inwardly spaced from the inner wall surface of the pump casing toward the central axis of the pump casing. A straight line a represents the result of the measurement in the case where the head coefficient of the pump is in excess of 60%, a curved line b shows the result of the measurement in the case where the head coefficient of the pump is 50%, a curved line c is of the case where the head coefficient of the pump is 40%, and a curved line d is of the case where the head coefficient of the pump is 20%. It is found from FIG. 11 that the circumferential flow speeds obtained at those points where the ratio $r/R_1$ is smaller than about 0.8 (that is, $h>0.2\ R_1$) are much smaller than those at the points where the ratio $r/R_1$ is larger than 0.8. Accordingly, by setting the distance h from the inner wall surface of the pump casing to each of the air intake ports 9 so as to meet the above Equation (2), it is possible to make smaller the influence of the swirling flow speed on the air intake ports and reduce the centrifugal forces due to the swirling flow, whereby a sufficient amount of air can be stably sucked into the pump to advantageously reduce the vibration of the pump. However, if the intake ports 9 are too close to the axis of the pump casing 2, there is a possibility that foreign matter clogs the suction bell. For the reason, this ratio $r/R_1$ is preferably selected to be greater than 0.4 (that is, $h<0.6\ R_1$)

Each of the above-described embodiments is provided with a plurality of air intake ports. The reason why the suction of air is stabilized to reduce the vibration of the pump by providing two or more air intake ports will now be described with reference to FIG. 12 in which the experimental data obtained by examining the relation between the number of air intake ports and the vibration of the pump are plotted. A curved line e represents the changes in the vibration ratio obtained from the cases where 1 to 20 air intake ports were provided in the inner wall surfaces of the suction bells 3 of pumps. A curved line f represents the changes in the vibration ratio obtained from the cases where 1 to 20 air intake ports were provided in pumps of the embodiment of FIG. 9 such that the distance h from the inner wall surfaces of the suction bells 3 to the intake ports 9 was set to be 0.2 $R_1$ with respect to the radius $R_1$ of each pump casing inner wall surface at the position of the intake ports. As will be seen from FIG. 12, the vibration of the pump can be reduced greatly in the case where two or more air suction ports are provided compared with the case where a single air suction port is provided. Particularly, the provision of five or more air suction ports can reduce vibration of the pump down to an extremely low level. The experiment data shown in FIG. 12 was obtained from the pump impeller having five vanes. It is hence appreciated that, by selecting the number of air intake ports equal to or more than the number of the pump vanes and arranging the air intake ports with equal intervals in the circumferential direction, air can be evenly introduced into the flow paths between the respective vanes to reduce the vibration of the pump. It is also understood from the curved line f that, even when only two air intake ports are provided each at a position inwardly spaced from the inner wall surface of the suction bell, the vibration of the pump can be reduced to a large extent.

Figure 13:
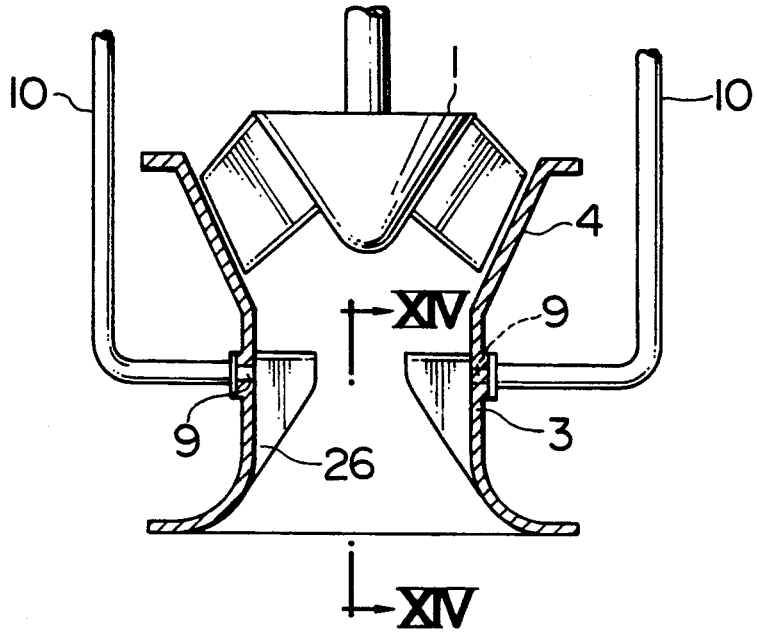
FIG. 13 is a detailed vertical sectional view of an important part of an eighth embodiment of the present invention.
Figure 14:
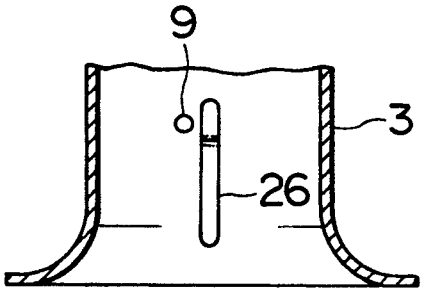
FIG. 14 is a view taken along a line XIV—XIV in FIG. 13.

FIGS. 13 and 14 show a still further embodiment of the present invention. In this embodiment, a pair of tapered ribs are provided on the inner wall surface of the suction bell 3 of the pump casing 4 and a pair of air suction ports 9 are provided at positions adjacent the ribs 26, respectively, and in the inner wall surface of the suction bell 3 in diametrically opposite relation. The air suction ports 9 are each communicated with the atmosphere through an intake pipe 10. This embodiment can also provide an advantageous effect similar to that of the embodiment shown in FIG. 9. Specifically, even if there occurs a swirling flow near the inlet of the pump impeller 1, the ribs 26 can serve to suppress the swirling flow. This allows the pressure to be less fluctuated at the positions of the air intake ports 9, so that air can be stably sucked in a sufficient amount, thereby reducing the vibration of the pump.

Operation of the embodiments shown in FIGS. 9 and 13 will now be described. In these embodiments, when the pump is operated at a lower water level, air is sucked through the air intake pipes 10 because the pressure at the intake ports 9 becomes lower than the atmospheric pressure. At this time, since the intake ports 9 are located at a position where they are less influenced by the swirling flow near the inlet of the pump impeller, the pressure at the intake ports 9 is less fluctuated and air can be sucked in a stable manner. Furthermore, since the influence of centrifugal forces due to the swirling flow is also small, a sufficient amount of air can be sucked into the pump to reduce the vibration of the pump.

What is claimed is:

1. A vertical shaft pump for use in a pump pit comprising:

a pump casing having a lower end with a suction opening formed therein;

an impeller disposed in said pump casing above said suction opening;

at least one air intake port disposed in said pump casing at a position radially inwardly spaced from an inner wall surface of said pump casing, between said impeller and said suction opening, by a distance h; and intake pipe means for communicating said at least one air intake port with the atmosphere, wherein said at least one air intake port is operative to allow atmospheric air to be sucked therethrough into said pump casing automatically depending upon a vacuum level in said pump casing due to a difference in pressure between the vacuum and the atmospheric pressure during a pumping operation below the lowest pump pit water level specific to the pump and below which the atmospheric air may be sucked through said suction opening, to thereby allow the pump to be operated to automatically reduce the pump discharge as the water level in said pump pit is lowered, and wherein said distance h is given by:

$$0.2R_1 \leqq h \leqq 0.6R_1$$

where $R_1$ is the radius of the inner wall surface of said pump casing at the position of said intake port.

2. A vertical shaft pump according to claim 1, wherein said air intake pipe means has one end connected to said air intake port and another end communicated with the atmosphere in said pump pit at a position above the highest water level in said pump pit.

3. A vertical shaft pump according to claim 1, wherein a plurality of such air intake ports are provided.

4. A vertical shaft pump according to claim 3, wherein the number of said air intake ports is equal to the number of vanes of said impeller or an integer multiplied by the number of said impeller vanes.

5. A vertical shaft pump for use in a pump pit comprising:

a pump casing having a suction opening;

an impeller disposed in said pump casing below a position corresponding to the lowest water level in said pump pit below which said pump starts to suck air through said suction opening during an operation;

a plurality of air intake ports provided in said pump casing at a position below said impeller with equal intervals in the circumferential direction of said pump casing; and intake pipe means for communicating said air intake ports with the atmosphere, wherein each air intake port has its axis inclined with respect to a plane perpendicular to the axis of said pump casing.

6. A vertical shaft pump according to claim 5, wherein the axis of each air intake port is inclined upwardly.

7. A vertical shaft pump according to claim 5, wherein the axis of each air intake port is inclined downwardly.

8. A vertical shaft pump according to claim 1, wherein each air intake port has its axis inclined with respect to the axis of said pump casing in the direction of swirling of water caused by rotation of said impeller.

9. A vertical shaft pump according to claim 8, wherein said intake pipe means comprises pipe members provided for respective intake ports, each pipe member has a part extending through said pump casing into the interior of said pump casing, and said part of said pipe member has an open end which forms the air intake port.

10. A vertical shaft pump according to claim 1, wherein each of said intake ports is opened in the inner wall surface of said pump casing, and projections for weakening force of water flow in said pump casing are provided on one of the upstream and downstream sides of said air intake ports, respectively.

11. A vertical shaft pump according to claim 1, wherein said pump casing has a lower portion flared outwardly, said lower portion is positioned below said impeller, and said air intake ports are formed in said lower portion below the region of said lower portion having the minimum inner diameter.

12. A vertical shaft pump according to claim 3, further including a plurality of ribs provided on the inner wall surface of said pump casing to diminish a swirling flow of water in said pump casing, said ribs projecting radially inwardly from said inner wall surface, wherein a plurality of holes communicating with said intake pipe means are formed in said pump casing, and wherein air passages communicating with said holes are formed in said ribs, respectively, said air passages having inner open ends forming the intake ports.

13. A vertical shaft pump according to claim 12, wherein the number of said ribs is equal to the number of vanes of said impeller.

14. A vertical shaft pump according to claim 1, further including an intake air regulating valve provided in said intake pipe means.

15. A vertical shaft pump according to claim 1, further including a plurality of ribs provided on the inner wall surface of said pump casing to diminish a swirling flow of water in said pump casing, said ribs projecting radially inwardly from said inner wall surface, and wherein each air intake port is opened in the inner wall surface of said pump casing between each pair of said ribs adjacent to each other in the circumferential direction.

16. A vertical shaft pump according to claim 15, wherein each air intake port is disposed adjacent to one of said ribs and downstream of that rib as viewed in the direction of the swirling flow of water in said pump casing.

17. A vertical shaft pump for use in a pump pit comprising:

a pump casing having a suction opening;

an impeller disposed in said pump casing above said suction opening;

at least one hold formed in said pump casing at a position below said impeller;

intake pipe means for communicating said hole with the atmosphere; and at least one rib provided on the inner wall surface of said pump casing and projecting radially inwardly of said pump casing;

wherein said rib has formed therein a passage communicating with said hole, wherein said passage has an inner end disposed in the interior of said pump casing to form an air intake port, and wherein said hole is operative to allow atmospheric air to be sucked therethrough and through said air intake port into said pump casing automatically depending upon a vacuum level in said pump casing due to a difference in pressure between the vacuum and the atmospheric pressure during a pumping operation below the lowest pump pit water level specific to the pump and below which the atmospheric air may be sucked through said suction opening, to thereby allow the pump to be operated to automatically reduce the pump discharge as the water level in said pump pit is lowered.

18. A vertical shaft pump according to claim 17, wherein the distance h from the inner wall surface of said pump casing to the inner end of said passage is give by:

$$0.2R_1 \leqq h \leqq 0.6\ R_1$$

where $R_1$ is the radius of the inner wall surface of said pump casing at the position of said intake port.

19. A vertical shaft pump according to claim 17, wherein said rib extends in the axial direction of said pump casing along the inner wall surface of said pump casing, and said rib has a lower edge inclined and extending radially outwardly toward the inner wall surface of said pump casing.

20. A vertical shaft pump according to claim 19, wherein said passage is formed in said rib at a position above the upper end of said inclined lower edge of said rib.

21. A vertical shaft pump according to claim 17, wherein said rib is integral with said pump casing.

22. A vertical shaft pump according to claim 18, wherein said hole is provided in plural number and the number of said ribs is the same as the number of said holes.

23. A vertical shaft pump according to claim 22, wherein the number of said holes and the number of said ribs are respectively the same as the number of vanes of said impeller.

24. A vertical shaft pump according to claim 23, wherein said impeller is disposed below a position, in said pump casing, corresponding to said lowest pump pit water level.

25. A vertical shaft pump according to claim 21, wherein said impeller is disposed below a position, in said pump casing, corresponding to said lowest pump pit water level.

26. A vertical shaft pump according to claim 20, wherein said impeller is disposed below a position, in said pump casing, corresponding to said lowest pump pit water level.

27. A vertical shaft pump according to claim 19, wherein said impeller is disposed below a position, in said pump casing, corresponding to said lowest pump pit water level.

28. A vertical shaft pump according to claim 18, wherein said impeller is disposed below a position, in said pump casing, corresponding to said lowest pump pit water level.

* * * * *